United States Patent [19]

Graffin

[11] Patent Number: 4,635,689

[45] Date of Patent: Jan. 13, 1987

[54] METHOD AND APPARATUS FOR MONITORING AND CONTROLLING THE FILLING OF RECEPTACLES WITH A DETERMINED WEIGHT OF MATERIAL

[75] Inventor: Andre J. J. Graffin, La Ferte Bernard, France

[73] Assignee: Etablissements A. Bertaud, Vitrolles, France

[21] Appl. No.: 671,668

[22] Filed: Nov. 15, 1984

[30] Foreign Application Priority Data

Nov. 18, 1983 [FR] France ..... 83 18418

[51] Int. Cl.[4] ..... B65B 3/28; B65B 3/32

[52] U.S. Cl. ..... 141/1; 141/83; 141/146; 177/1

[58] Field of Search ..... 177/58, 25, 1; 141/83, 141/1, 98, 129, 144–152, 167, 181–183, 188, 250, 255, 258, 259, 392, 128

[56] References Cited

U.S. PATENT DOCUMENTS

| | | | |
|---|---|---|---|
| 1,726,297 | 8/1929 | Hansen | 141/146 X |
| 2,280,614 | 4/1942 | Ayers | 177/50 |
| 3,215,173 | 11/1965 | Rutherford | 141/83 |
| 3,648,741 | 3/1972 | Croasdale et al. | 141/9 |
| 4,060,109 | 11/1977 | Sotoma | 141/83 |
| 4,065,032 | 12/1977 | Lydiksen | 141/83 X |
| 4,266,691 | 5/1981 | Wolwowicz | 141/128 X |
| 4,320,855 | 3/1982 | Richiardi et al. | 177/50 |
| 4,460,308 | 7/1984 | Moon et al. | 141/83 X |

*Primary Examiner*—Stephen Marcus
*Assistant Examiner*—Ernest G. Cusick
*Attorney, Agent, or Firm*—Sughrue, Mion, Zinn, Macpeak and Seas

[57] ABSTRACT

A rotary carrousel of a filling installation includes a plurality of filling stations each equipped with a volumetric dispenser (37) whose volume may be varied by varying its dispensing time or the stroke of a piston in a cylinder. At least one of the filling stations includes a balance (36). As a receptacle (39) passes through the filling installation in a filling station equipped with a balance, it is first weighed empty while the corresponding dispenser (37) is filled, and it is then weighed continuously as the material is transferred from the dispenser to the receptacle. The actual weight of material dispensed is determined by comparing the full and empty weights of the receptacle. This weight is compared with a set weight. Any drift which is detected from the set weight can be corrected for subsequent receptacles passing through the filling installation by varying the volume of the material dispensed.

3 Claims, 4 Drawing Figures

METHOD AND APPARATUS FOR MONITORING AND CONTROLLING THE FILLING OF RECEPTACLES WITH A DETERMINED WEIGHT OF MATERIAL

BACKGROUND OF THE INVENTION

The present invention relates to a method and to apparatus for monitoring and controlling the filling of receptacles which are successively engaged in a production line filling installation.

In many industries, such as the food, the chemicals, the oil, and the pharmaceuticals industries, there is a need to package materials which are more or less fluid for subsequent distribution. To be profitable, the packaging operation must be both fast and accurate. Modern installations are fast, but there is still a need to improve accuracy. Ideally, each receptacle would be filled with exactly the desired quantity of material. However, achieving such accuracy runs into several problems which are due in particular to the fast throughput required by the filling installations and also to the physical properties of the materials being packaged. Fast throughput makes it difficult to verify the quantity of material which is effectively inserted into each receptacle, while the key physical properties of the materials to be packaged, even when such materials are homogeneous, are their density and their viscosity, both of which are liable to vary with temperature and thus have an effect on the quantities actually dispensed. If receptacles moving along a production line filling installation are to be accurately filled, it is necessary not only to dispense an exact quantity of the material to be packaged but also to verify that the receptacles (either individually or statistically) contain only the desired exact quantity so as to be able, if necessary, to correct the dispensing of material to subsequent receptacles.

One known way of dispensing material to receptacles is to use a volumetric dispenser e.g. of the type including timer means controlling the opening and closing of an orifice from a tank of the material to be packaged, or else of the type comprising a piston and cylinder assembly in which the stroke of the piston defines the volume of the material to be dispensed. Such dispensers are adjusted to dispense a volume of a given material at a given temperature. If the temperature of the material inserted therein varies over the course of a working day, or over the course of several days, etc., the quantity of material actually dispensed to the receptacles will vary. In order to verify the quantity of material inserted in the receptacles, and if necessary to modify the adjustment of the dispensers so as to compensate for any underfill or overfill, it is known to use a balance since weight is the only characteristic which can be used to accurately define the quantity of a material regardless of its temperature.

U.S. Pat. No. 2,925,835 describes a method and apparatus for monitoring and controlling the filling of receptacles which are successively engaged in a production line filling installation. In the example described in that U.S. patent, the receptacles are conveyed by a moving belt to a single filling station where they are filled one-by-one with a quantity of material which is dispensed by a volumetric dispenser including a timer. Once filled, the receptacles continue their path along the moving belt until they arrive at a point where they are removed mechanically from the moving belt one after the other and placed on a fixed balance located adjacent to the belt. They are weighed thereon, and then mechanically replaced on the belt. The weight of the full receptacle is compared with a set value, and if necessary, the adjustment of the volumetric dispenser is modified. Although such a system is theoretically capable of solving the problems encountered, it nevertheless suffers from several drawbacks in practice: firstly transferring a receptacle from the moving belt to a balance, waiting a suitable length of time for the balance to settle, and then transferring the receptacle back to the belt limits the possible throughput to a fairly low value; and secondly the system makes no allowance for receptacles of different tare weights, even though mass produced receptacles, eg. made of glass, can often vary considerably in their empty or tare weights. It can thus impossible to determine the weight of a packaged material with sufficient accuracy.

SUMMARY OF THE INVENTION

In a first aspect the present invention provides a method of monitoring and controlling the filling of receptacles placed in succession in a filling installation which includes a rotary carrousel type member having a plurality of filling stations each of which receives a receptacle for filling with a desired set weight of material, the method comprising the following steps:

at each filling station, the corresponding receptacle receives a volume of material, which volume is defined by a control unit;

at least some of the receptacles are weighed during filling by means of a balance which moves with the receptacle in its filling station;

the weight of material inserted into the receptacle is measured and compared with a desired set weight; and the difference between the measured weight and the set weight is used to act on the control unit to modify the volume of material inserted into receptacles which arrive subsequently at the filling installation.

Preferably, the complete path through the filling installation of a receptacle placed on a balance associated with one of the filling stations, comprises in succession, a stage during which the receptacle is weighed empty, and a stage during which the receptacle is both filled and weighed, calculating means then determining the exact weight of the material inserted into the receptacle.

The volume of material inserted into the receptacles may be varied either by timing means or else by a cam which varies the stroke of a dispensing piston.

In a second aspect, the present invention provides apparatus for monitoring and controlling the filling of receptacles placed in succession in a filling installation which includes a rotary carrousel type member having a plurality of filling stations each of which receives a receptacle for filling with a desired set weight of material, wherein:

each filling station includes means for inserting a volume of material into a receptacle;

at least some of the filling stations include a balance which moves with the station to continuously weigh a receptacle before, during and after filling;

the installation includes a control unit for controlling the volume of material inserted into the receptacles by each filling station; and the installation includes calculating and storage means for storing the empty weight of a receptacle and the weight of the same receptacle when full, which weights are delivered by each balance, the calculating means then calculating the weight of material inserted into the receptacle and causing the control unit to vary the volume of the material which is inserted into the receptacles arriving subsequently at the filling station, in the event that any variation is required.

The control unit may be a timer defining a time period during which each filling station inserts material into a receptacle, or else it may be a cam acting on the stroke of a piston in a cylinder of a dispenser, with at least a portion of the cam being movable to modify the stroke of the piston, and hence the volume dispensed by the dispenser.

BRIEF DESCRIPTION OF THE DRAWINGS

An embodiment of the invention is described by way of example with reference to the accompanying drawings, in which.

DETAILED DESCRIPTION OF THE PREFERRED EMBODIMENT

Figure 1:
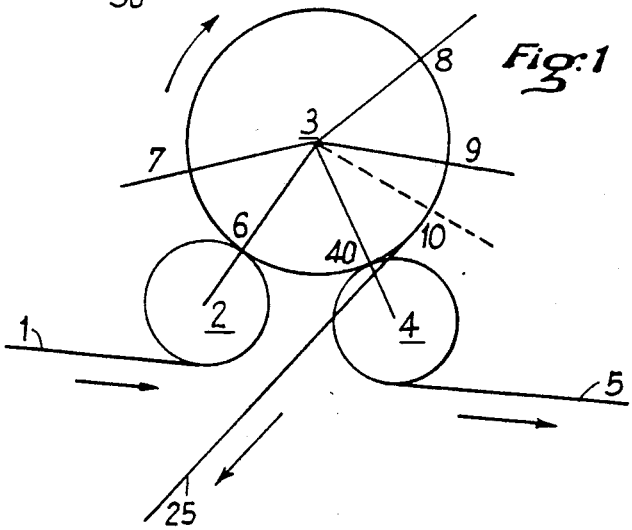
FIG. 1 is a diagrammatic plan view of a filling installation comprising a rotary carrousel type unit on which the various stages of the path of a receptacle are marked for the case where the receptacle is received in a filling station which includes a balance.

FIG. 1 shows the various stages of the path of a receptacle which is placed on one of the filling stations equipped with a balance of a production line filling installation including a rotary carrousel 3. The receptacles arrive on a conveyor 1 which applies them to a distribution star 2 for inserting the receptacles into respective filling stations of the carrousel. In the present example the receptacle in question is inserted into a filling station having a balance. It is not essential for all of the filling stations to have individual balances. The receptacle is inserted at point 6. The carrousel is rotating. Between point 6 and the next marked point 7, the empty receptacle is weighed, and its empty or tare weight is stored. At the same time as the empty receptacle is weighed, the filling of the associated volumetric dispenser is terminated. This filling began at point 40. Between the point 7 and the point 8, and between the point 8 and the point 9 material is dispensed from the volumetric dispenser into the receptacle. In the first portion of the receptacle filling path (7-8) filling takes place rapidly, while in the second portion (8-9) filling takes place slowly. The receptacle is continuously weighed from its arrival in the carrousel to its exit therefrom. Between the point 9 and a point 10 the balance stabilizes and the weight of the full receptacle is determined. A calculating and control unit 41, eg. a microprocessor, calculates the exact weight of material dispensed into the receptacle on the basis of the final weight and the stored tare weight, and then compares the resulting weight of material with a set value. If necessary steps are taken to modify the amount dispensed to receptacles that arrive subsequently in the carrousel. The advantage of having the balance moving with carrousel is to provide sufficient time for the weighing operation to be accurate (ie. for the balance to settle), without slowing down the rate at which receptacles are filled. Filled receptacles leave the carrousel 3 either at the above-mentioned point 10 and along a conveyor path 25 running tangentially to the carrousel, or else at the point 40 by means of a second distribution star 4 which enables the receptacles to leave along an output conveyor 5 running in a preferred direction, eg. parallel to the input conveyor 1.

Figure 2:
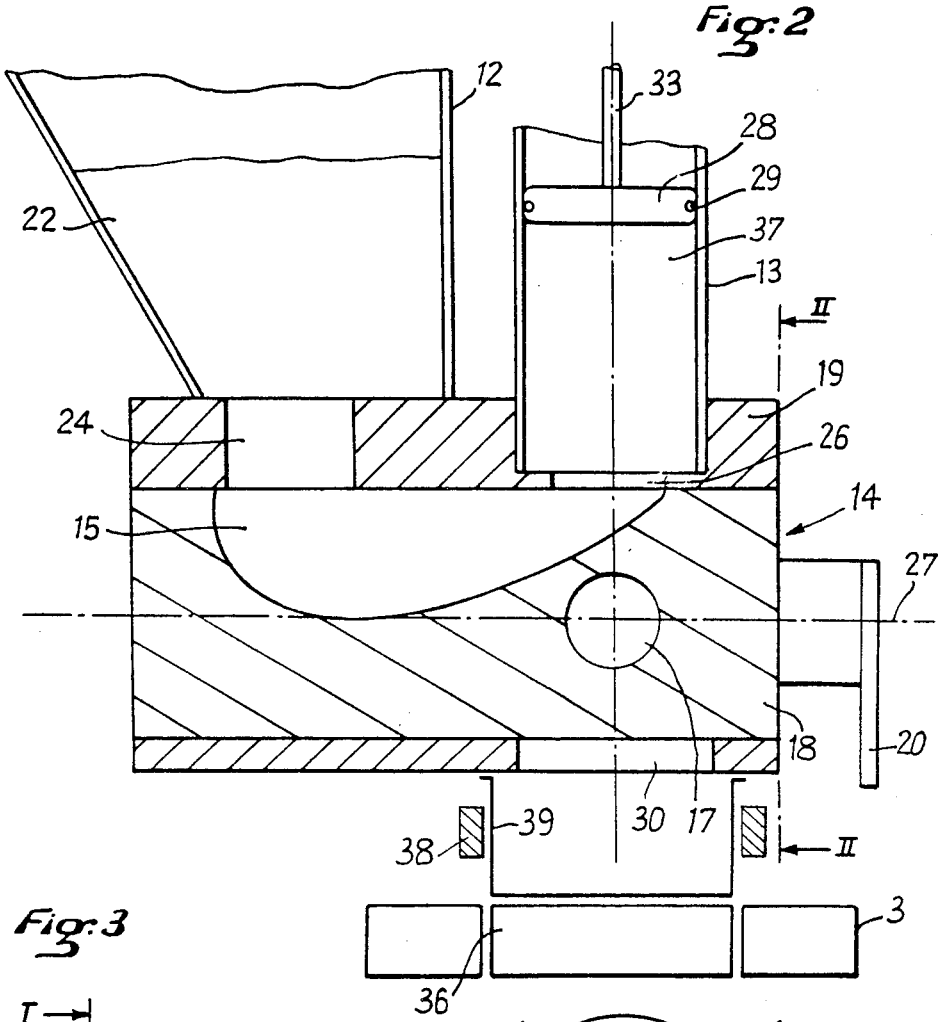
FIG. 2 is a diagrammatic section through on example of a filling station.
Figure 3:
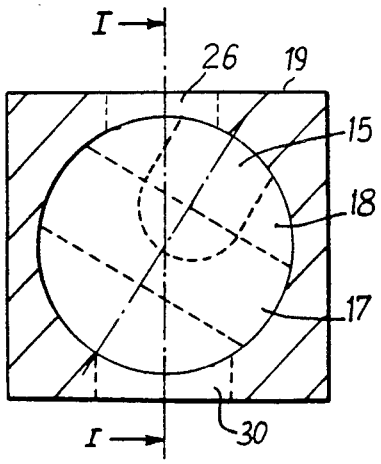
FIG. 3 is a diagrammatic section on a line II—II through the FIG. 2 filling station, but with its feed hopper and volumetric dispenser omitted.

FIG. 2 is a diagrammatic section through one embodiment of a filling station equipped with a balance. Each filling station is situated on the rotary carrousel and comprises: an electronic balance 36; means 38 for centering a receptacle 39; a hopper 12 for feeding material 22 to be packaged; a volumetric dispenser 37 including a piston 28 fitted with a seal 29, a cylinder 13 in which the piston 28 is free to slide, and a rod 33 for activating the piston; and a tap 14 comprising a tubular body 19 in which a cylindrical plug 18 capable of rotating in the body is received.

The body 19 has: a horizontal axis 27; a vertical duct 24 through the upper wall of the body placed to receive material downwardly from the hopper 12; a vertical duct 26 through the upper wall of the body placed immediately below the volumetric dispenser 37; a countersunk upper portion to the volumetric dispenser duct 26 for receiving the dispenser cylinder 13; and a vertical duct 30 through the lower wall of the body and on the same axis as the dispenser duct 26. The duct 30 leads to a receptacle 39 placed beneath it.

The cylindrical plug 18 fills the bore of the body 19 and is free to rotate about the axis 27. It includes: a hollowed out portion 15 which serves, in a predetermined position of the plug relative to the body, to put the hopper duct 24 into communication with the dispenser duct 26; a dispensing duct 17 which is not in communication with the hollowed out portion 15 and which serves, in a different predetermined position of the plug relative to the body, to put the dispenser 37 in communication with the lower duct 30 through the body 19; and a control lever 20 by which the plug 18 may be rotated relative to the body 19. Suitable actuator means (not shown) which may be electrically, pneumatically or otherwise driven, act on the lever 20 on instructions from the calculating and control unit 41.

When a filling station is between the points 10 and 7 shown in FIG. 1, the plug 18 is placed as shown in FIG. 2 so that the hollowed out portion 15 puts the hopper into communication with the dispenser. When a filling station is between point 7 and a point somewhere between points 8 and 9 at which filling is stopped, the plug 18 is placed so that the duct 17 is aligned with the ducts 26 and 30, thereby putting the volumetric dispenser in communication with a receptacle 39.

Figure 4:
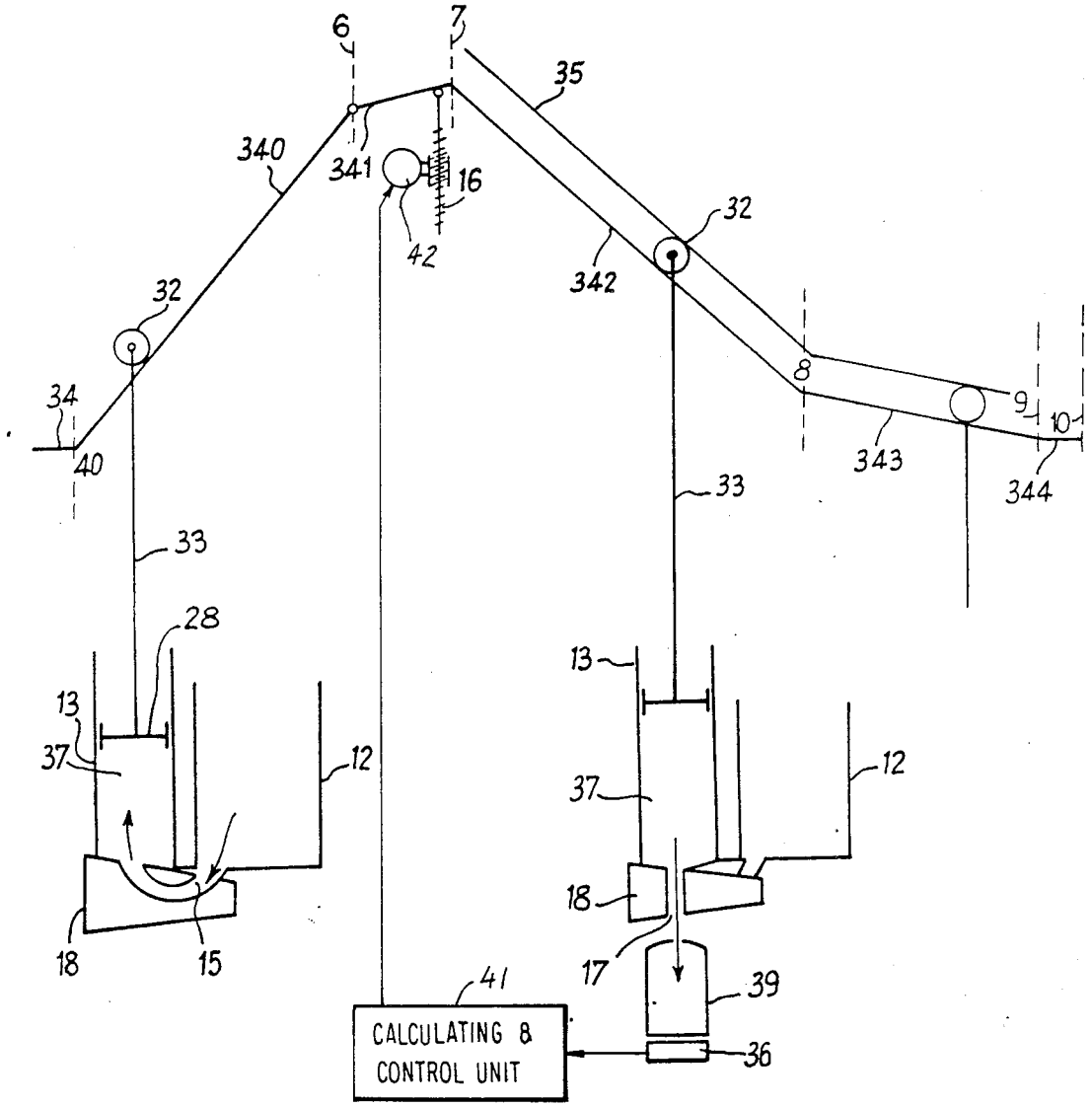
FIG. 4 is a diagrammatic developed view of a cam and of two filling stations, with the left hand filling station being engaged on a rising ramp of the cam and with the right hand filing station being engaged on a falling ramp of the cam.

FIG. 4 is a diagrammatic development of a cam showing the cam controlling operation of two filling stations. It must be understood that in practice this cam is not developed as shown, but rather is wrapped round the periphery of a cylinder having the same axis as the carrousel. Further it should be understood that it may control as many filling stations as is convenient, which, in practice, will normally be more than two.

The cam 34 represented in FIG. 4 has a rising ramp with two successive slopes: a ramp 340 from points 40 to 6, and an adjustable ramp 341 between points 6 and 7. It then has a falling ramp with two different slopes: a ramp 342 between points 7 and 8, and a ramp 343 between points 8 and 9. Finally there is a horizontal portion 344 between points 9 and 40. An upper cam 35 runs parallel to the falling ramp of the cam 34 between the points 7 and 9. The points are numbered as in FIG. 1. The rising path corresponds to the volumetric dispenser 37 being filled. The falling path corresponds to the material being transferred from the volumetric dispenser 37 to the receptacle 39 at two different rates.

The cams 34 and 35 are fixed relative to the rotation of the carrousel 3 on which the filling stations are mounted. The cam 34 controls the operation of each filling station by guiding a cam-follower wheel 32 which is fixed to the piston rod 33. Between the point 40 and the point 7 it is the cam 34 alone which controls the cam-follower wheel 32. Conversely, between the point 7 and the point 9 (ie. for the falling ramp), the cam-follower wheel 32 is controlled by both cams 34 and 35.

The cam 34 includes a portion of rising ramp 341 whose slope may be adjusted by means of a motor and reduction gear unit 42 driving an endless screw 16. If the calculating and control unit 41 detects any difference between the weight of material actually inserted into a receptacle and the set weight, it causes the slope of the ramp 341 to be modified in such a direction as to counteract the drift from the set weight. Clearly this action is only effective for subsequent receptacles arriving at the carrousel.

As a general rule, only a fraction of the filling stations in any given carrousel is fitted with a balance, and in any case the corrective action is only applicable to receptacles arriving at the carrousel several receptacles later than the receptacle on which a filling error is first detected. Thus the advantage of the apparatus is statistical: any tendency for the filling weight to drift away from its set value is corrected within a relatively short time regardless of the cause.

I claim:

1. A method of filling receptacles in a filling installation including a rotary carrousel having a plurality of filling stations, each including a volumetric dispenser having a piston (28) movable into a cylinder (13), said method comprising the steps of:

(a) successively and individually introducing the receptacles in a filling station and weighing at least one receptacle placed in a control filling station while said receptacle is still empty, (b) simultaneously with step (a), filling a corresponding volumetric dispenser (37) having its piston (28) connected to a common adjustable volume control member (34), (c) filling each receptacle by emptying said corresponding volumetric dispenser into said receptacle, (d) simultaneously with step c, continuously weighing said receptacle at said control filling station and comparing an actual net weight of product in said receptacle at said control filling station with a reference value weight, and (e) setting said volume control member according to a difference between said actual net weight of product and said reference value weight as soon as said volumetric dispenser is empty at said control station.

2. A receptacle filling installation, comprising: a rotary carrousel, a plurality of filling stations on said carrousel each comprising a volumetric dispenser (37) including a piston (28) movable into a cylinder (13), and means for filling said volumetric dispenser with a product and for thereafter emptying said volumetric dispenser into a receptacle to thus fill said receptacle, said piston (28) of each dispenser being connected to a common control member (34) by an actuating member (33), said control member including an adjustable volume determining portion (341) having a position determined by a setting member (42), at least one of the filling stations including a receptacle weighing balance which moves with an associated station such that said weighing balance progressively stabilizes during the filling of said receptacle, said installation further comprising a control unit (41) receiving outputs from said weighing balance as inputs for storing a weight of an empty receptacle when introduced on a weighing balance and determining a net weight of product in said receptacle at said weighing balance, said control unit having an output connected to said setting member for adjusting the position of said volume determining portion in response to a difference signal between an input signal from a weighing balance and a reference value when the volumetric dispenser associated with said weighing balance is empty.

3. An installation according to claim 2, wherein said volume determining portion comprises a cam ramp having an adjustable slope.

* * * * *